US007682186B2

(12) United States Patent
Tang et al.

(10) Patent No.: US 7,682,186 B2
(45) Date of Patent: Mar. 23, 2010

(54) COMPUTER HOUSING WITH RETRACTING HEADPHONE CABLE

(75) Inventors: Jia-He Tang, Shenzhen (CN); Wen-Haw Tseng, Taipei Hsien (TW); Shih-Fang Wong, Taipei Hsien (TW); Hui-Ting Guo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/203,934

(22) Filed: Sep. 4, 2008

(65) Prior Publication Data

US 2009/0061677 A1 Mar. 5, 2009

(30) Foreign Application Priority Data

Sep. 5, 2007 (CN) ..... 2007 1 0201591

(51) Int. Cl.
*H01R 13/72* (2006.01)

(52) U.S. Cl. ..... 439/501; 439/4; 439/164; 242/378.2; 242/385

(58) Field of Classification Search ..... 439/501, 439/4, 528; 242/378, 378.1, 378.2, 385, 242/385.1, 388, 388.1
See application file for complete search history.

(56) References Cited

U.S. PATENT DOCUMENTS

| | | | | |
|---|---|---|---|---|
| 4,713,497 | A * | 12/1987 | Smith | 191/12.2 R |
| 6,070,823 | A * | 6/2000 | Clary | 242/388.1 |
| 6,179,238 | B1 * | 1/2001 | Phillipps | 242/378.4 |
| 7,317,446 | B1 * | 1/2008 | Murphy | 345/163 |
| 2005/0170686 | A1 * | 8/2005 | Thorland et al. | 439/501 |
| 2007/0258204 | A1 * | 11/2007 | Chang et al. | 361/683 |

* cited by examiner

*Primary Examiner*—Edwin A. Leon
*Assistant Examiner*—Vanessa Girardi
(74) *Attorney, Agent, or Firm*—Frank R. Niranjan

(57) ABSTRACT

A computer housing is provided. The computer housing includes a front panel with an opening formed thereon. A cable winding assembly is disposed within the computer housing and includes a stop member, a cable winding member, two support members, and an elastic rope. The cable winding member includes a jack receiving hole and at least one stop member receiving means formed on an outer circumferential surface thereof for accommodating a headphone jack and the stop member respectively. The stop member can be inserted through the opening. The two support members are attached to a bottom panel of the computer housing and include bearing holes formed threreon for supporting the cable winding member and allowing a rotation of the cable winding member. The elastic rope includes two ends fastened respectively to the cable winding member and one of the support members and is capable of being wound when the cable winding member rotates.

6 Claims, 8 Drawing Sheets

COMPUTER HOUSING WITH RETRACTING HEADPHONE CABLE

BACKGROUND

1. Technical Field

The present invention relates generally to computer housings and, more particularly, to a computer housing capable of retracting a headphone cable connected thereto.

2. General Background

Nowadays, personal computers are widely used. Personal computers including desktop computers for household use, are generally referred to as home computers. Home computers are often used for playing DVDs or CDs for entertainment. In some circumstances, when a user is enjoying the DVDs or CDs using a home computer, an earphone is needed to avoid disturbing others. The earphone can be removed from the computer or still kept connecting to the computer after use.

However, if the earphone is removed from the computer, it would not handy and convenient for use next time. If the earphone is still kept connected to the computer, the earphone cable usually becomes tangled and is not convenient for use.

Accordingly, there is a need to provide a desktop computer housing to solve the problems stated above.

SUMMARY

The invention relates to a computer housing. In an exemplary form, the computer housing includes a front panel with an opening formed thereon. A cable winding assembly is disposed within the computer housing and includes a stop member, a cable winding member, two support members, and an elastic rope. The cable winding member includes a jack receiving hole and at least one stop member receiving means formed on an outer circumferential surface thereof for accommodating a headphone jack and the stop member respectively. The stop member can be inserted through the opening on the front panel. The two support members are attached to a bottom panel of the computer housing and include bearing holes formed thereon for supporting the cable winding member and allowing a rotation of the cable winding member. The elastic rope includes two ends fastened respectively to the cable winding member and one of the support members. The elastic rope is capable of being wound when the cable winding member rotates and capable of driving the cable winding member to rotate back when it unwinds.

Other features and advantages will be or become apparent to one with skill in the art upon examination of the following drawings and detailed description. It is intended that all such additional features and advantages are included within this description, are within the scope of the present invention, and are protected by the accompanying claims.

DETAILED DESCRIPTION OF THE EMBODIMENTS

Figure 1:
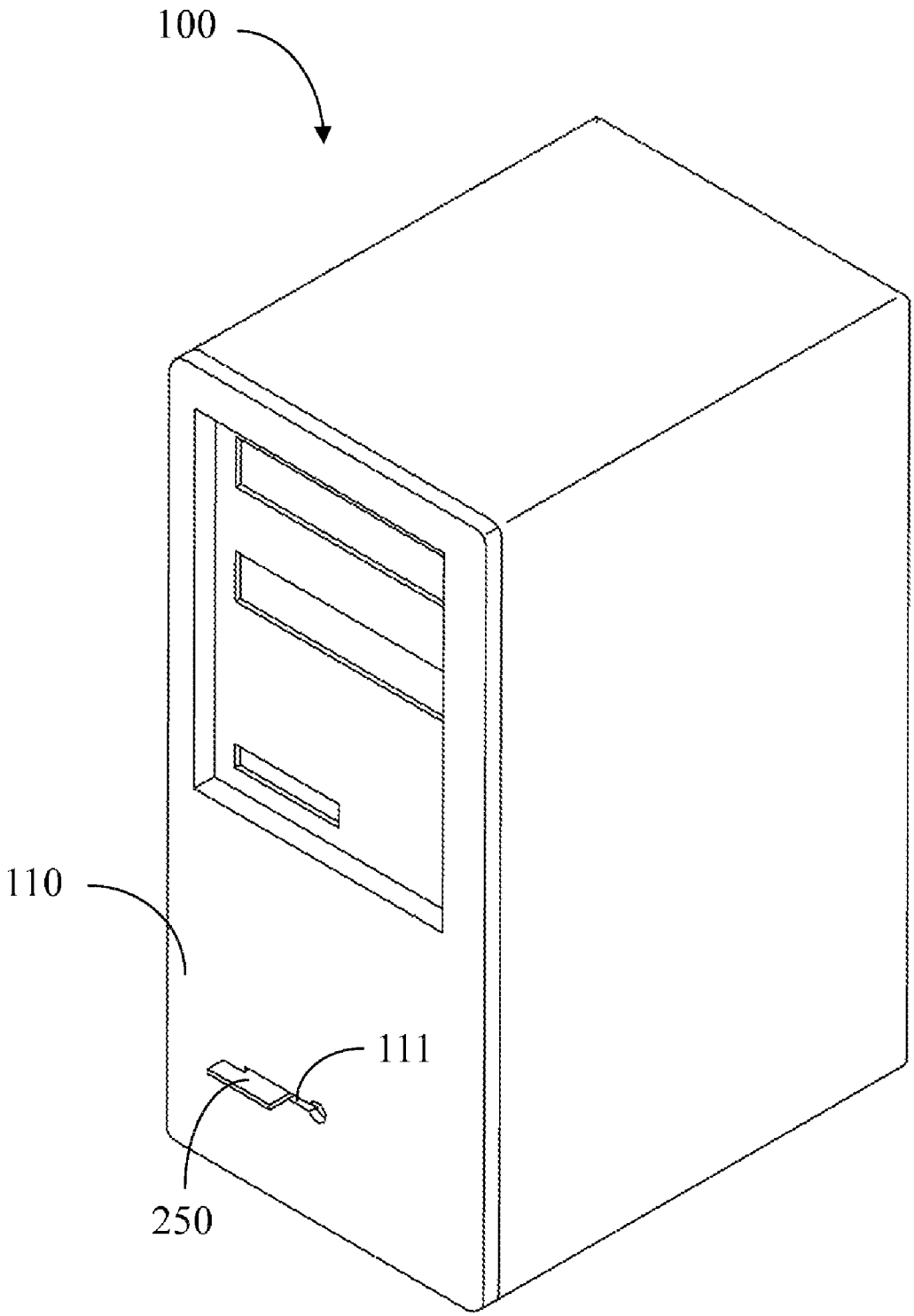
FIG. 1 is an isometric view of a computer housing in accordance with one embodiment of the present invention.

FIG. 1 is an isometric view of a computer housing 100 in accordance with one exemplary embodiment of the present invention. The computer housing 100 includes a front panel 110 with an opening 111 formed thereon. In one embodiment, the opening 111 is a horizontal slot.

Figure 2:
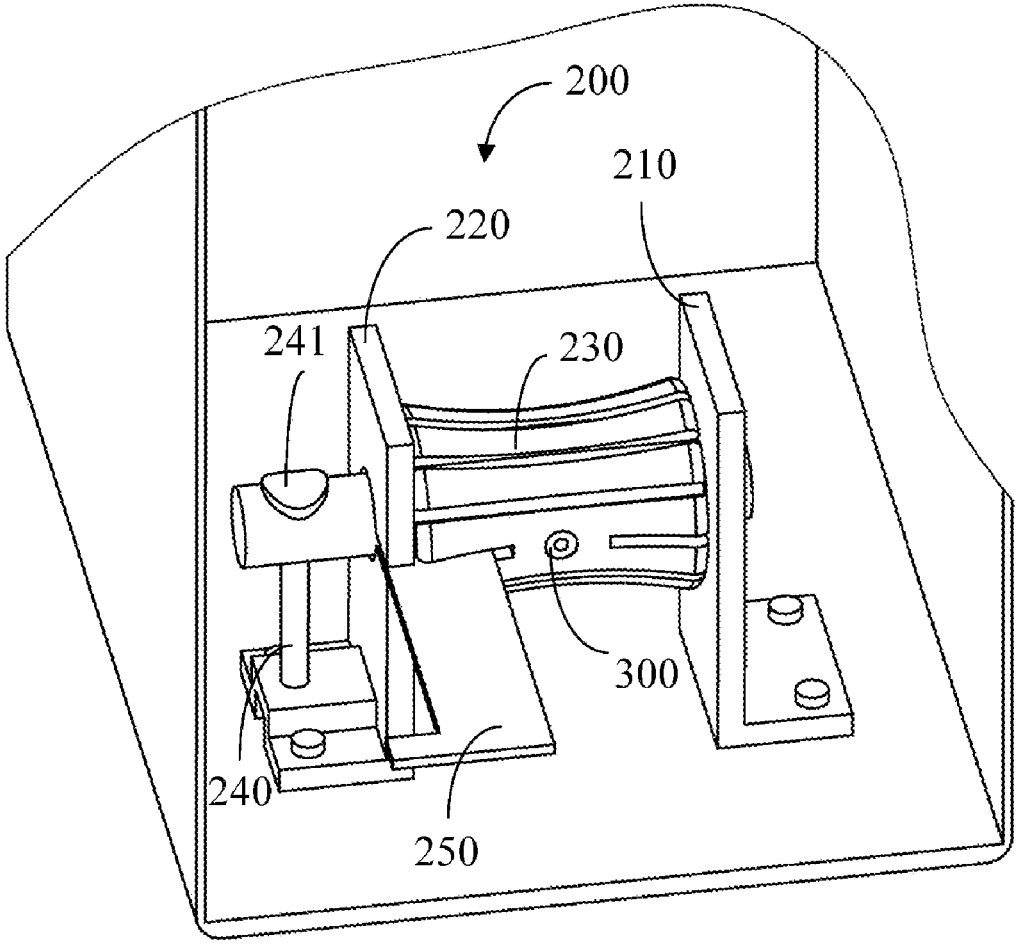
FIG. 2 is a partial, isometric view of the computer housing of FIG. 1 with a front cover omitted.
Figure 3:
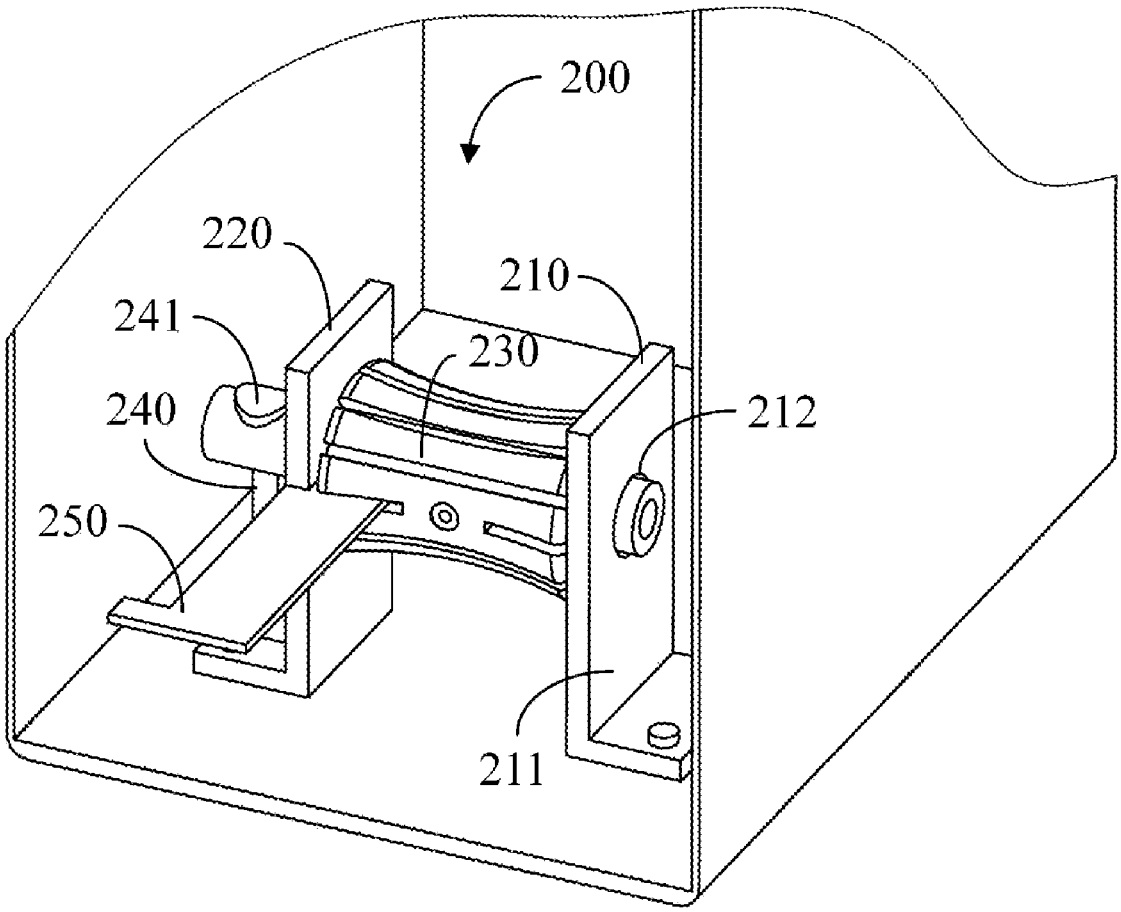
FIG. 3 is another partial, isometric view of the computer housing of FIG. 1, with different viewing aspect, also with the front cover omitted.
Figure 4:
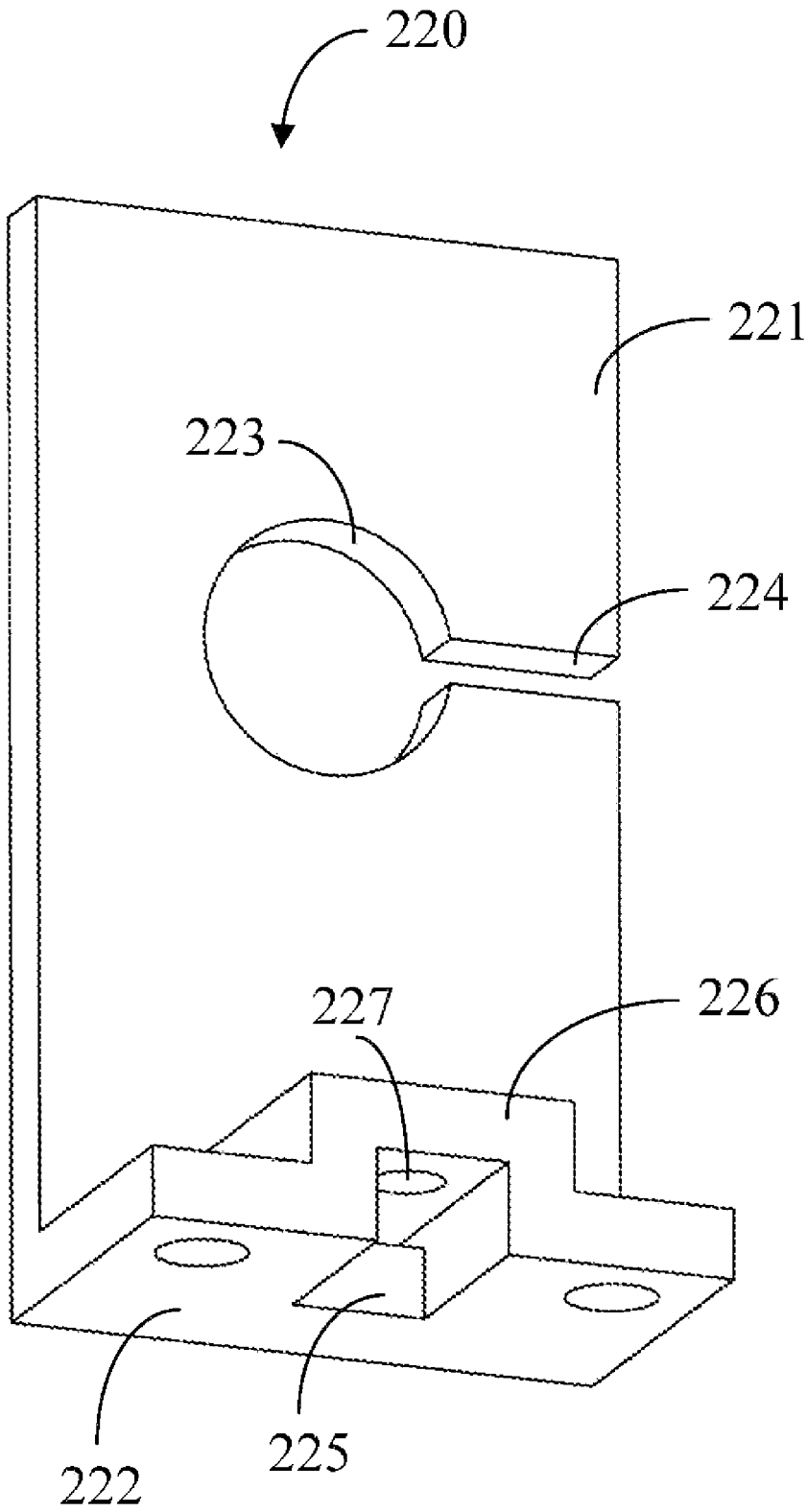
FIG. 4 is an isometric view of a support member that is shown in FIG. 2.

FIGS. 2 through 4 show a cable winding assembly 200 disposed within the computer housing 100. The cable winding assembly 200 is used for retracting a cable of an earphone (not shown) into the computer housing 100. In one embodiment, the cable winding assembly 200 is secured to a bottom panel of the computer housing 100. The cable winding assembly 200 includes a first support member 210, a second support member 220, a cable winding member 230, an elastic rope 240, and a stop member 250.

The first support member 210 and the second support member 220 are secured to the bottom panel of the computer housing 100 for supporting the cable winding member 230. The first support member 210 is L shaped and has a vertical wall 211 with a bearing hole 212 formed thereon.

The second support member 220 includes a vertical wall 221 and a base 222. A bearing hole 223 and a guiding groove 224 are formed on the vertical wall 221. The guiding groove 224 extends from a side surface of the vertical wall 221 and communicates with the bearing hole 223. A chamber 225 is formed on the bottom end of the base 222. The chamber 225 is defined cooperatively by a top wall 226 and three sidewalls (not labeled). A through hole 227 is formed on the top wall 226 and communicates with the chamber 225.

Figure 5:
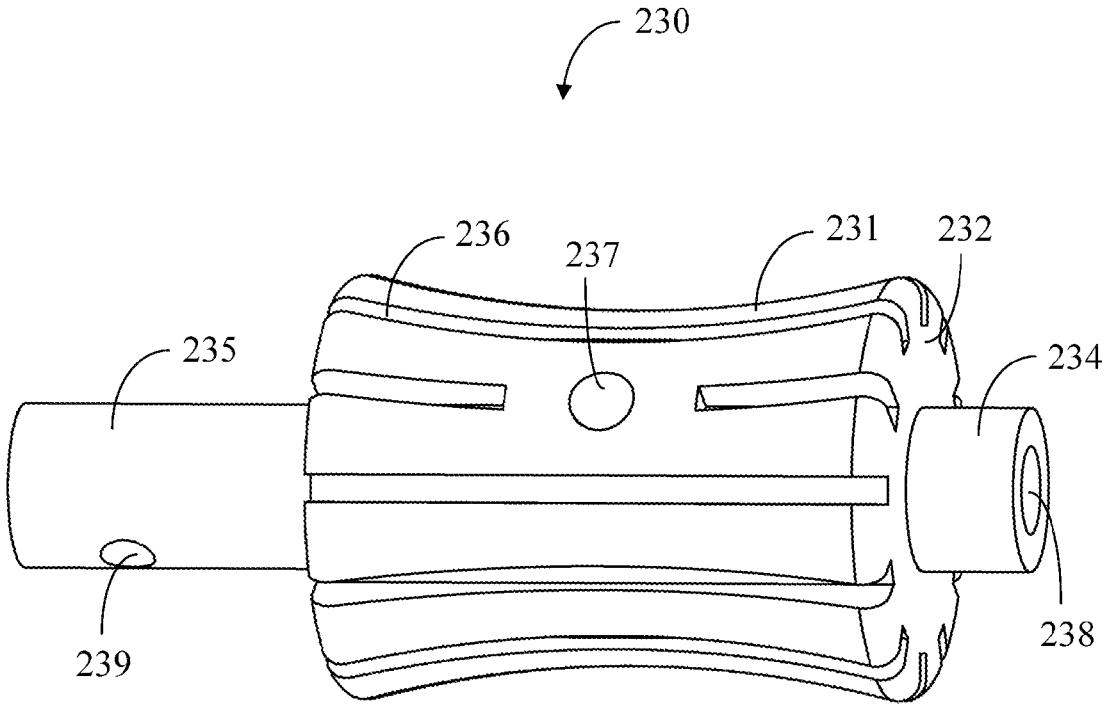
FIG. 5 is an isometric view of a cable winding member that is shown in FIG. 2.
Figure 6:
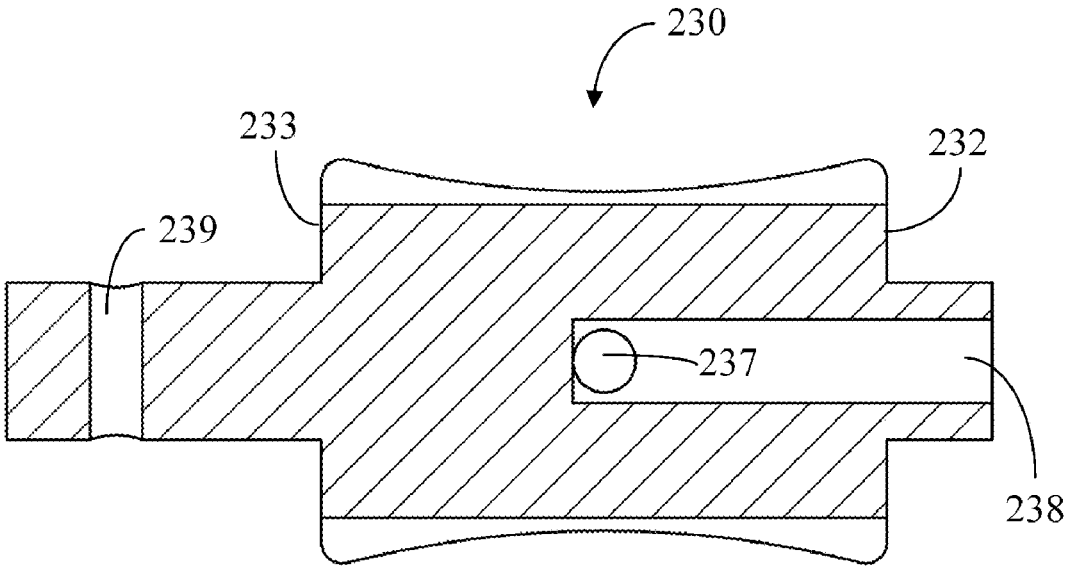
FIG. 6 is a sectional view of the cable winding member of FIG. 5.

FIGS. 5 and 6 illustrate the cable winding member 230. The cable winding member 230 includes a rotating surface 231 and two side ends 232, 233. The cable winding member 230 also includes a first shaft 234 at the side end 232 and a second shaft 235 at the side end 233. The two shafts 234 and 235 are coaxial.

Figure 8:
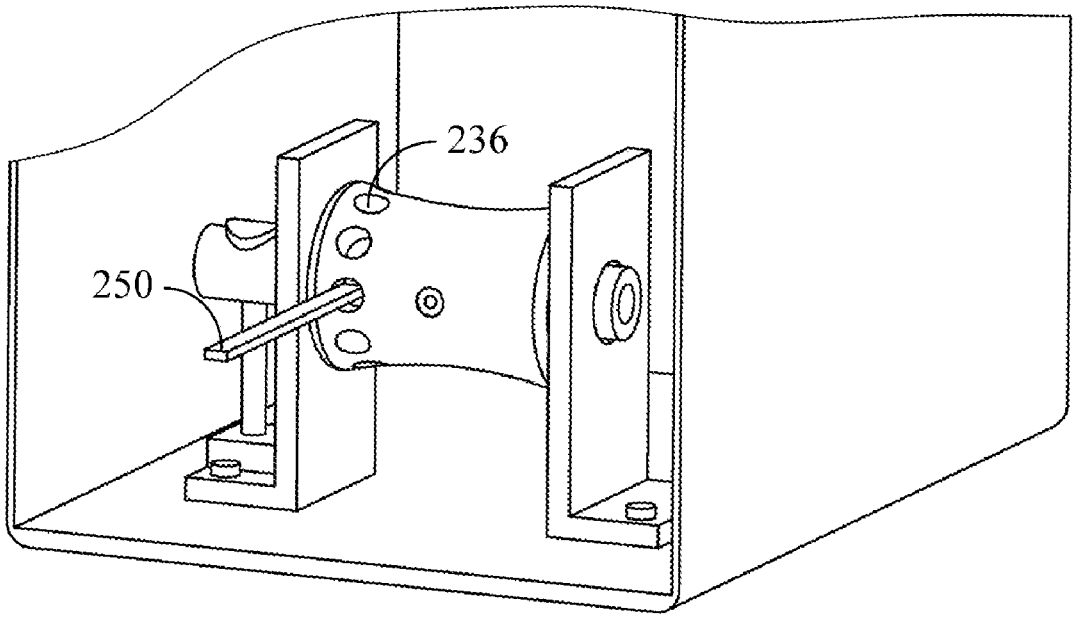
FIG. 8 is a partial view of a computer housing in accordance with another embodiment of the present invention, with the front cover omitted.

A plurality of stop member receiving means 236 and a jack receiving hole 237 are formed on the rotating surface 231. The jack receiving hole 237 is used for accommodating an earphone jack (not shown). In the illustrated exemplary embodiment shown in the FIGS. 5 and 6, the stop member receiving means 236 is in the form a plurality of grooves. Each of the grooves extends longitudinally along the axis of the two shafts 234 and 235. In another embodiment shown in FIG. 8, the stop member receiving means 236 is in the form of a plurality of holes formed on the rotating surface 231.

A wire receiving hole 238 is formed on the first shaft 234. A through hole 239 is formed, extending approximately perpendicularly to the axis of the second shaft 235, on the cylindrical surface of the second shaft 235. The wire receiving hole 238 communicates with the jack receiving hole 237, such that conductive wires can be guided out through the wire receiving hole 238 to connect with a motherboard (not shown) disposed within the computer housing 100.

The first shaft 234 and the second shaft 235 are respectively received in the bearing holes 212 and 223. The cable winding member 230 is thus held in position and can be rotated freely with respect to the first support member 210 and the second support member 220.

The elastic rope 240 is made of elastic material and extends through the through hole 239 and the through hole 227 and two ends of the elastic rope 240 are attached to the second shaft 235 and the second support member 220 respectively. In one embodiment, the elastic rope 240, when in a free state, is slightly stretched.

One end of the elastic rope 240, which is attached to the second shaft 235, is formed with a head 241 that has a larger diameter than that of the through hole 239, such that the head 241 can be retained above the through hole 239. At the other end, the elastic rope 240 may be attached to the second support member 220 by a knot (not shown) and the knot can be accommodated in the chamber 225 of the second support member 220.

Figure 7:
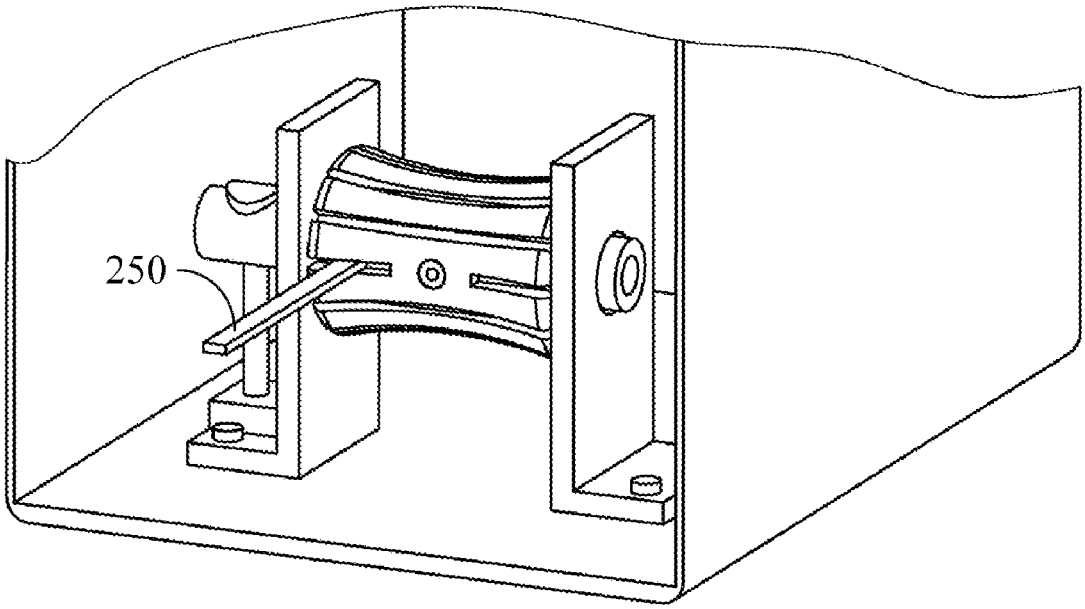
FIG. 7 is a partial view of a computer housing in accordance with another embodiment of present invention, with a front cover omitted.

The stop member 250, in one exemplary embodiment, is a flat panel and can be pushed through the opening 111 of the front panel 110 and then can be inserted into the guiding groove 224. The stop member 250 slides along the guiding groove 224 until being received in the stop member receiving means 236. In another exemplary embodiment shown in FIGS. 7 and 8, the stop member 250 is a thin stick.

In the process of pulling the earphone cable out, the cable winding member 230 rotates and thus the elastic rope 240 is winded around the second shaft 235. After the earphone cable, which is pulled out of the computer housing 100 and has a suitable length, the cable winding member 230 can be stopped by inserting the stop member 250 into the stop member receiving means 236 and the suitable length of earphone cable is kept out of the computer housing 100.

When the stop member 250 is pulled out of the stop member receiving means 236, the cable winding member 230 is rotated back by the spring force applied by the elastic rope 240. The earphone cable, which is kept out of the computer housing 100, is thus retracted into the computer housing 100 with the rotation of the cable winding member 230.

While various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. A computer housing with retracting headphone cable comprising:

a front panel with an opening formed thereon;

a stop member being slidable through the opening on the front panel;

a cable winding member including a stop member receiving means formed on an outer circumferential surface thereof for accommodating the stop member;

two support members secured to the computer housing for rotatably connecting the cable winding member thereto, wherein, a guiding member is formed on one of the support members for guiding the stop member to be received in the stop member receiving means;

an elastic rope fastened to the cable winding member and one of the support members, wherein the elastic rope is capable of being wound when the cable winding member rotates, and capable of driving the cable winding member to rotate when it unwinds.

2. The computer housing according to claim 1, wherein the guiding member comprises a groove.

3. A computer housing with retracting headphone cable comprising:

a front panel with an opening formed thereon;

a stop member being slidable through the opening on the front panel, wherein, the stop member is a flat panel and the opening of the front panel is a slot;

a cable winding member including a jack receiving hole and at least one stop member receiving means formed on an outer circumferential surface thereof for accommodating a headphone jack and the stop member respectively, wherein, the at least one stop member receiving means comprises a plurality of grooves that extend axially on the outer circumferential surface;

two support members attached to a bottom panel of the computer housing including bearing holes formed thereon for supporting the cable winding member and allowing a rotation of the cable winding member, wherein, a sliding groove is formed on one of the support members for guiding the stop member to be received in the stop member receiving means; and an elastic rope having two ends fastened respectively to the cable winding member and one of the support members, wherein the elastic rope is capable of being wound when the cable winding member rotates, and capable of driving the cable winding member to rotate when it unwinds.

4. The computer housing according to claim 3, wherein the stop member is of a stick shape.

5. The computer housing according to claim 1, wherein the cable winding member includes a wire receiving hole formed at one end and the wire receiving hole communicates with the jack receiving hole.

6. The computer housing according to claim 3, wherein the elastic rope is fastened to the cable winding member and one of the support members in a stretched state.

* * * * *